United States Patent [19]

Shum

[11] 3,973,542

[45] Aug. 10, 1976

[54] LIQUID FUEL INJECTION PUMPING APPARATUS

[75] Inventor: Peter Nai-Kee Shum, Reading, England

[73] Assignee: C.A.V. Limited, Birmingham, England

[22] Filed: Aug. 4, 1975

[21] Appl. No.: 601,409

Related U.S. Application Data

[63] Continuation of Ser. No. 448,743, March 6, 1974, abandoned.

[30] Foreign Application Priority Data

Mar. 6, 1973 United Kingdom ..... 10691/73

[52] U.S. Cl. ..... 123/140 R; 123/140 J

[51] Int. Cl.[2] ..... F02D 1/04

[58] Field of Search ..... 123/140 R, 140 J

[56] References Cited

UNITED STATES PATENTS

| | | | |
|---|---|---|---|
| 3,577,968 | 5/1971 | Staudt | 123/140 R |
| 3,759,236 | 9/1973 | Staudt | 123/140 R |
| 3,830,211 | 8/1974 | Bechstein | 123/140 R |

*Primary Examiner*—Charles J. Myhre
*Assistant Examiner*—Daniel J. O'Connor
*Attorney, Agent, or Firm*—Holman & Stern

[57] ABSTRACT

A liquid fuel pumping apparatus for supplying fuel to an internal combustion engine includes a member which is movable against the action of a spring system by means of centrifugally operable weights. The member is coupled to a fuel control rod of the pumping apparatus, and the spring system includes first and second springs. The first spring is preloaded so as to be deflected by the weights only when the speed of the engine attains a predetermined value. The other spring is deflected by the weights at lower engine speeds and also acts to transmit the force exerted by the weights to the first spring.

6 Claims, 4 Drawing Figures

LIQUID FUEL INJECTION PUMPING APPARATUS

This is a continuation of application Ser. No. 448,743 filed Mar. 6, 1974, now abandoned.

This invention relates to liquid fuel injection pumping apparatus for supplying fuel to internal combustion engines, and of the kind comprising an injection pump including a control element movable to adjust the quantity of fuel supplied by the injection pump at each injection stroke thereof, a centrifugal weight mechanism adapted to be driven at a speed which varies in accordance with the speed at which the associated engine is operating, a member movable by the weight mechanism, resilient means for resisting movement of the member by the weight, a lever which is pivotally connected to the member and the control element at spaced positions, and manually operable means for effecting movement of the lever about one or the other of its pivots.

The object of the invention is to find such an apparatus in a simple and convenient form.

According to the invention, in an apparatus of the kind specified, said resilient means comprises a pair of springs one of which is pre-loaded so as to be deflected by said weight mechanism only when the speed of the engine attains a predetermined value, deflection of said one spring allowing a reduction in the amount of fuel supplied to the engine thereby to limit the maximum speed of the engine, the other of said springs being deflected by said weight mechanism at lower engine speeds above idling speed, said other spring acting to transmit the force exerted by said weight mechanism to said one spring.

Figure 1:
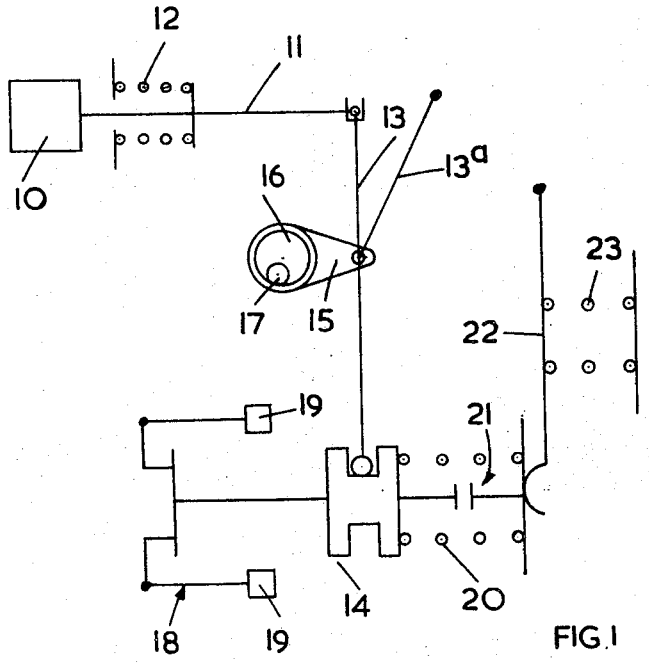
Figure 3:
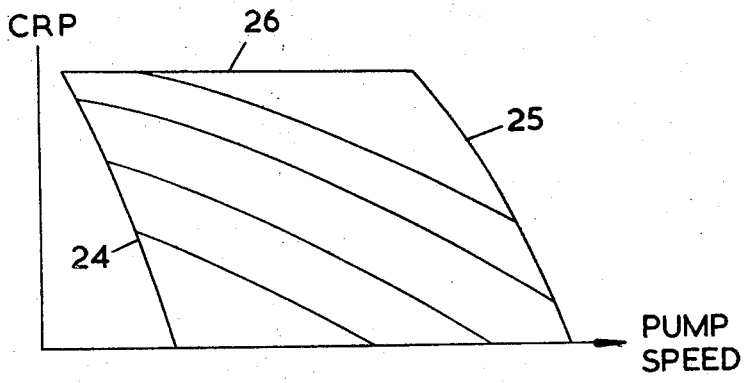
Figure 2:
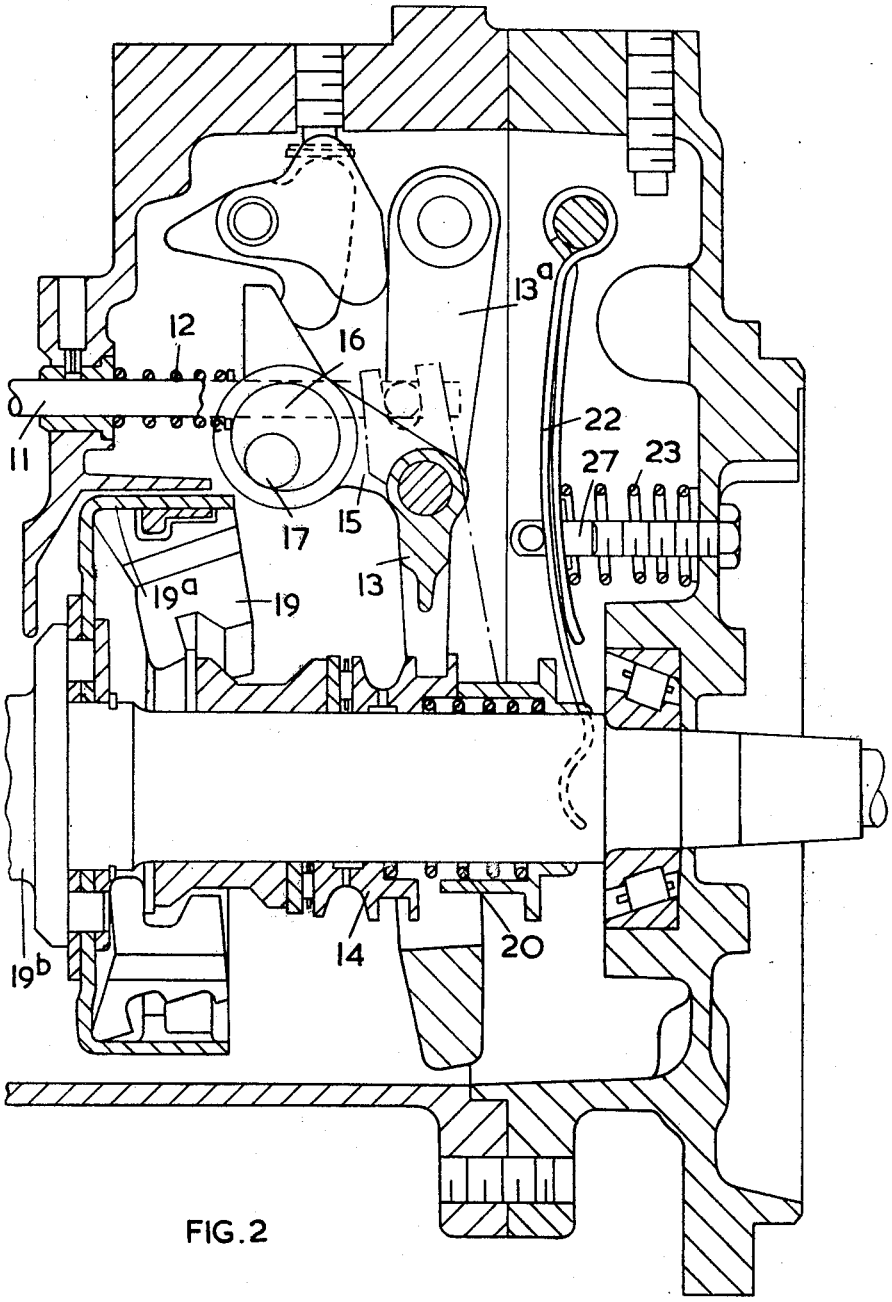
Figure 4:
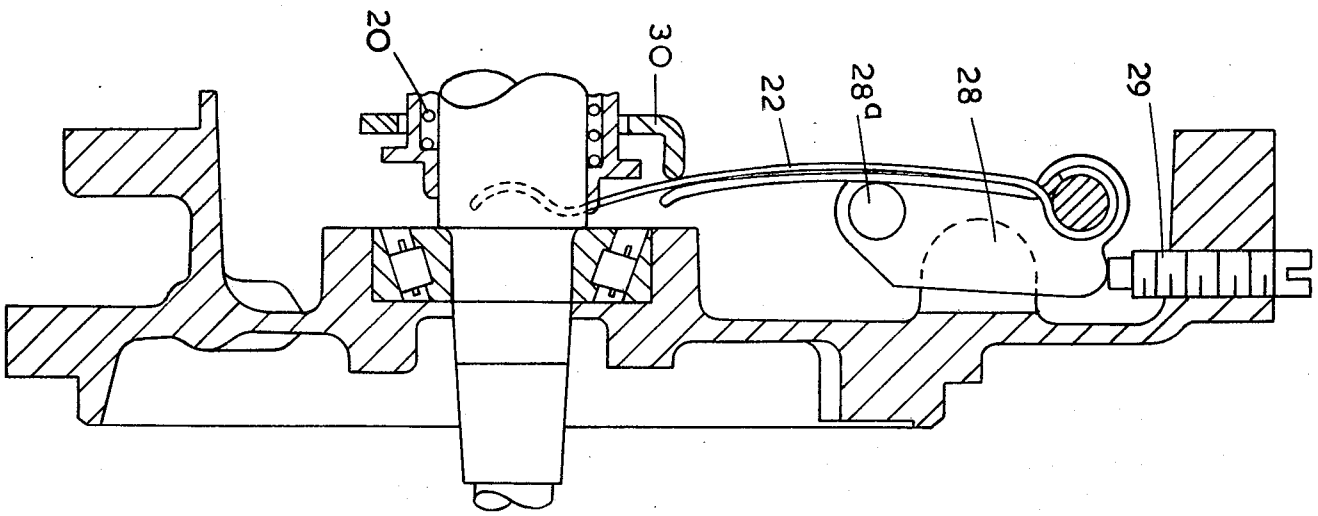

The invention will now be described with reference to the accompanying drawings in which:

FIG. 1 shows a diagrammatic representation of the apparatus in accordance with the invention, FIG. 2 shows a sectional view of a practical form of apparatus, FIG. 3 shows the fuel delivery characteristics of the apparatus, and FIG. 4 shows an alternative arrangement of the springs.

Referring to FIG. 1 of the drawings, the apparatus comprises a fuel injection pump 10 which is adapted to be driven in timed relationship with the associated engine. The injection pump supplies fuel to the engine cylinders in turn, and the quantity of fuel supplied is determined by the position of a control element in the form of a control rod 11. The control rod is movable towards the left as seen in FIG. 1, to reduce the amount of fuel supplied by the injection pump, and movement in the opposite direction effects an increase in the quantity of fuel supplied. Associated with the control rod is a light coiled compression spring 12, the duty of which is to take up any backlash in the system.

Also provided is a lever 13, one end of which slides on a pin fixed on the control rod, and the other end of which is located within a circumferential groove formed in a sleeve member 14. Intermediate the sleeve member, and the control rod, the lever 13 is pivotally connected to an arm 15 mounted about a bush 16 which is itself eccentrically mounted upon an angularly movable shaft 17. The shaft 17 is coupled in use, to the operators foot control. Also provided is a swing arm 13*a* pivotally connected at one end to the joint between the lever 13 and arm 15 and at its other end it is pivotally connected to a fixed part.

The member 14 is loaded in one direction that is to say towards the right, as seen in FIG. 1, by means of a centrifugal weight mechanism 18 which includes as shown, a pair of weights 19 carried in a cage not shown. The cage is adapted to be driven at a speed proportional to the speed at which the associated engine is operating, and as the speed of operation increases, the weights move outwardly and effect axial movement of the member 14. Such movement of the member 14 moves the lever 13 about its pivotal connection with the lever 15 and thereby moves the control rod to reduce the amount of fuel supplied to the engine.

The movement of the member 14 under the action of the weights 19, is against the action of three springs. The first spring which is referenced 20 is a light spring and the extent of its deflection by the weights is limited by abutting members 21. The second spring is a leaf spring which is referenced 22, one end of which is pivotally mounted about a fixed stop and the other end of which bears against an abutment of the spring 20. The third spring is a coiled compression spring 23 which acts on the spring 22 intermediate the ends thereof. Although not shown, the spring 23 is preloaded and the force required to deflect the spring 23 is higher than that required to deflect the spring 22, this in turn being higher than the force required to deflect or compress the spring 20.

In operation, with the shaft 17 set in the idling position, the spring 20 in conjunction with the weights is operative to control the idling speed of the engine. In this situation, the springs 22 and 23 merely constitute an abutment for the spring 20. When the shaft 17 is moved by the operator to effect an increase in the engine speed, the pivot point between the lever 13 and arm 15 moves towards the right along an arc described by the swing arm 13*a*, the lever 13 effectively pivoting about its pivotal connection with the member 14. When this occurs, the control rod 11 is moved to effect an increase in the quantity of fuel supplied to the engine. As the engine speed increases, the spring 20 will be compressed its maximum extent, and deflection of the spring 22 will occur. The spring 22 together with the weight mechanism will therefore provide a governing effect, and whilst the position of the control rod 11 will largely be dependent upon the position of the shaft 17, it will nevertheless be to a certain extent dependent upon the speed at which the engine is operating. With the shaft 17 set to provide a fairly low engine speed, it is possible for the member 14 to be moved by the weight mechanism by an amount sufficient to reduce the amount of fuel supplied to the engine to zero. However, if the shaft 17 is set to provide a higher engine speed, it is possible that at a particular speed the force exerted on the spring 22 will equal the pre-loading force of the spring 23 and when this occurs, the spring 23 will be deflected and thereby progressive reduction in the quantity of fuel supplied to the engine will occur so that its maximum speed will be limited.

FIG. 3 shows the fuelling characteristics which may be obtained with the apparatus described. The curve 24 is determined by the spring 20 and the curve 25 by the combined springs 22 and 23 with the spring 23 having the dominant effect. The upper straight line 26 is obtained when the shaft 17 is set to provide maximum speed and is determined by a stop which is not shown in FIG. 1. The other curves are those which are obtained at intermediate setting of the shaft 17, and it will be seen that at a low setting, the spring 23 is not brought into play, neither is the stop which determines the maximum amount of fuel which is supplied to the engine.

Referring now to FIG. 2, identical reference numerals are utilised wherever possible. It will be seen from FIG. 2 that the weights 19 are carried in a cage 19*a* which is mounted on a rotary shaft 19*b*. Conveniently, the shaft 19*b* is extended to constitute the drive shaft of the injection pump.

The spring 23 is pre-loaded by means of an adjustable T shaped member 27. The shank of the member 27 extends through an aperture in the leaf spring 22 and draws the latter into engagement with the coiled compression spring 23. The member 27 is adjusted to provide the desired pre-load of the compression spring.

In the alternative arrangement shown in FIG. 4 the compression spring 23 together with the member 27 are omitted. In their place is a spring pre-loading lever 28 which is pivotally mounted about the point of attachment of the leaf spring to the body and which mounts a pin 28*a* which bears against the spring intermediate its ends. Moreover, the position of the lever 28 is adjustable by means of an adjustable screw 29. Also provided is a stop 30 which engages the spring between the pin 28*a* and the end of the spring which engages the abutment of the spring 20.

The portion of the spring disposed between the stop 30 and its point of attachment is the equivalent of the spring 23 and the extent of pre-load is determined by the position of the screw 29, the remaining portion of the spring is the equivalent of the spring 21. The mode of operation is as described with reference to FIG. 2.

I claim:

1. A liquid fuel injection pumping apparatus comprising an injection pump including a control element movable to adjust the quantity of fuel supplied by the injection pump at each injection stroke thereof, a centrifugal weight mechanism adapted to be driven at a speed which varies in accordance with the speed at which the associated engine is operating, a member movable by the weight mechanism, resilient means for resisting movement of the member by the weight, a lever which is pivotally connected to the member and the control element at spaced positions, and manually operable means for effecting movement of the lever about one or the other of its pivots to determine the setting of said control element, the improvement being that said resilient means comprises an idling spring and a pair of springs, said idling spring and said pair of springs being positioned in series with each other and acting against said member to resist movement thereof by said centrifugal weight mechanism, means limiting the extent of deflection of said idling spring whereby said idling spring is effective in conjunction with the weight mechanism to control the output of the pump only during idling of the engine, means pre-loading one of said pair of springs so that deflection of said one spring by said weight mechanism occurs only when the engine speed attains a predetermined value, deflection of said one spring irrespective of the setting of said manually operable means allowing movement of said member to reduce the amount of fuel supplied to the engine so as to limit the maximum speed of the engine, the other of said springs being deflected by said weight mechanism at a lower engine speed than said predetermined value, whereby with increasing speeds below said predetermined value depending upon the setting of said manually operable means there will be a gradual reduction in the amount of fuel supplied to the engine.

2. The apparatus as claimed in claim 1 wherein said one spring comprises a coiled compression spring and said other spring comprises a leaf spring which is pivotally mounted at one end and which, at its other end, engages said member through said idling spring.

3. The apparatus as claimed in claim 2 in which the coiled compression spring engages one face of the leaf spring intermediate the ends thereof, means being provided which engages the opposite surface of the leaf spring, for pre-loading the coiled compression spring.

4. The apparatus as claimed in claim 3 in which said means comprises a T shaped member having a shank portion extending through an aperture in the leaf spring, the head of the T-shaped member engaging said opposite surface of the leaf spring, the shank portion of the T-shaped member extending within the coiled compression spring and being of adjustable length to determine the pre-load of the compression spring.

5. A liquid fuel injection pumping apparatus comprising an injection pump including a control element movable to adjust the quantity of fuel supplied by the injection pump at each injection stroke thereof, a centrifugal weight mechanism adapted to be driven at a speed which varies in accordance with the speed at which the associated engine is operating, a member movable by the weight mechanism, resilient means for resisting movement of the member by the weight, a lever which is pivotally connected to the member and the control element at spaced positions, and manually operable means for effecting movement of the lever about one or the other of its pivots to determine the setting of said control element, the improvement being that said resilient means comprises an idling spring and a pair of springs, said idling spring and said pair of springs being positioned in series with each other and acting against said member to resist movement thereof by said centrifugal weight mechanism, means limiting the extent of deflection of said idling spring whereby said idling spring is effective in conjunction with the weight mechanism to control the output of the pump only during idling of the engine, means preloading one of said pair of springs so that deflection of said one spring by said weight mechanism occurs only when the engine speed attains a predetermined value, deflection of said one spring irrespective of the setting of said manually operable means allowing movement of said member to reduce the amount of fuel supplied to the engine so as to limit the maximum speed of the engine, the other of said springs being deflected by said weight mechanism at a lower engine speed than said pre-determined value, whereby with increasing speeds below said pre-determined value depending upon the setting of said manually operable means there will be a gradual reduction in the amount of fuel supplied to the engine, said pair of springs being defined by a single leaf spring which at one end is pivotally mounted about a fixed point, the other end of the spring bearing against said member, there being provided a fixed stop engaging the spring at a position spaced from said other end thereof, and an adjustable stop engaging the spring intermediate said one end thereof and said fixed stop and said member constituting said other spring.

6. The apparatus as claimed in claim 5 in which said adjustable stop comprises a pin carried by a plate pivotable about said fixed point.

* * * * *